United States Patent [19]

Duthie et al.

[11] Patent Number: 5,044,887

[45] Date of Patent: Sep. 3, 1991

[54] BLOWER FAN IMPELLERS

[75] Inventors: Anthony J. Duthie; Mark Cullen, both of Horsham, England

[73] Assignee: Johnston Engineering Limited, Dorking, England

[21] Appl. No.: 427,602

[22] Filed: Oct. 27, 1989

[30] Foreign Application Priority Data

Dec. 6, 1988 [GB] United Kingdom ..... 8828411

[51] Int. Cl.[5] ..... F01D 5/14

[52] U.S. Cl. ..... 416/223 B; 416/182; 416/224; 415/121.2; 55/199; 209/154

[58] Field of Search ..... 415/121.2, 200, 203, 415/206, 217.1, 195; 416/178, 182, 183, 185, 187, 224, 241 R, 223 B; 55/52, 199, 398; 209/154

[56] References Cited

U.S. PATENT DOCUMENTS

| | | | |
|---|---|---|---|
| 1,156,118 | 10/1915 | Warg | 416/178 |
| 1,739,604 | 12/1929 | Monroe . | |
| 1,869,655 | 8/1932 | Beebe . | |
| 2,224,617 | 12/1940 | Sylvan | 416/187 |
| 2,559,785 | 7/1951 | Morgan | 416/186 R |
| 3,408,796 | 11/1968 | Murray | 415/121.2 |
| 3,902,823 | 9/1975 | Minato et al. . | |
| 4,108,570 | 8/1978 | Yamabe | 416/186 |
| 4,877,431 | 10/1989 | Avondoglio | 55/345 |

FOREIGN PATENT DOCUMENTS

| | | | |
|---|---|---|---|
| 1232697 | 1/1967 | Fed. Rep. of Germany . | |
| 22111 | 2/1977 | Japan | 416/224 |
| 125396 | 9/1980 | Japan | 416/186 R |
| 23096 | of 1911 | United Kingdom . | |
| 287448 | 5/1928 | United Kingdom . | |
| 325076 | 2/1930 | United Kingdom . | |
| 330306 | 6/1930 | United Kingdom . | |
| 737785 | 10/1955 | United Kingdom . | |
| 864645 | 4/1961 | United Kingdom . | |
| 999666 | 7/1965 | United Kingdom . | |
| 1048364 | 11/1966 | United Kingdom . | |
| 1142732 | 2/1969 | United Kingdom . | |
| 1293553 | 10/1972 | United Kingdom . | |
| 1416882 | 12/1975 | United Kingdom . | |
| 1523972 | 9/1978 | United Kingdom . | |
| 1582000 | 12/1980 | United Kingdom . | |
| 2061399 | 5/1981 | United Kingdom . | |
| 2190305 | 11/1987 | United Kingdom . | |

*Primary Examiner*—John T. Kwon

*Attorney, Agent, or Firm*—Young & Thompson

[57] ABSTRACT

A fan impeller comprises a back plate, a front plate and a plurality of blades lying between the front and back plates, wherein the blades are fitted relative to the axis of rotation of the impeller to provide a leading edge adjacent the back plate, so as to impart, in use, a lateral sideways vector to a stream of and passing along the blades. At least two of the blades may be of increased thickness than the remaining blades. These improvements increase the life of the fan impeller significantly.

13 Claims, 2 Drawing Sheets

BLOWER FAN IMPELLERS

This invention relates to fan impellers used in, but not limited to, road sweeping vehicles of the suction type.

Many suction type road sweeping vehicles utilise a centrifugal exhauster fan for its sweeping action, which generates a vacuum within an air-tight container mounted on a vehicle chassis. Debris from the road is sucked through suction conduits connected to the container and once in the container, the debris is separated from the air by means of a separation system before being exhausted by the fan to the atmosphere.

Generally an impeller comprises a front and a back plate held together by blades.

In use, abrasive dust and grit particles may pass through the separation system into the centrifugal fan which leads to abrasion and erosion of the fan impeller blades and of the fan casing volute. Such abrasion and gradual erosion can be disasterous as this can lead to collapse of the impeller blades which hold the front and back plates of the impeller together and which may cause the impeller itself to split into two parts. This may result in damage to the fan casing, possibly to the vehicle as a whole and places the driver and others in potential danger. Abrasion can also lead to erosion of the casing itself.

Applicant's earlier patent GB 1582000 describes a system to combat wear erosion of the blades and a means to prevent disintegration of the impeller. In this system, blades having a c-shaped channel section were disclosed, which are hardened all over the working surface and the sides of the channel preventing wear from taking place on the back and front plates. Each blade additionally has two metal bars welded thereto which are fixed to the front and back plates such that if the blades did eventually wear after prolonged use, the bars would hold the front and back plates together producing a substantial increase in safety compaired to the prior art impellers.

Although these improvements enhance the life of the blades and prevent the impeller from disintegrating after failure of the blades, they do not enhance the life of the casing which is also subject to wear. Furthermore, the spacer bars tend to cause a build up of dirt beneath the blade and cause the impeller to become out of balance.

It is an object of the present invention to provide an improved fan impeller which overcomes these disadvantages.

According to the present invention there is disclosed a fan impeller comprising a back plate, a front plate and a plurality of blades lying between the front plate and the back plate, wherein the blades are tilted to provide a raised leading edge adjacent said back plate so as to impart a laterial sideways vector to a stream of air passing along the blades.

A specific embodiment of the invention will now be described by way of example only and with reference to the accompanying drawings, of which:

Figure 1:
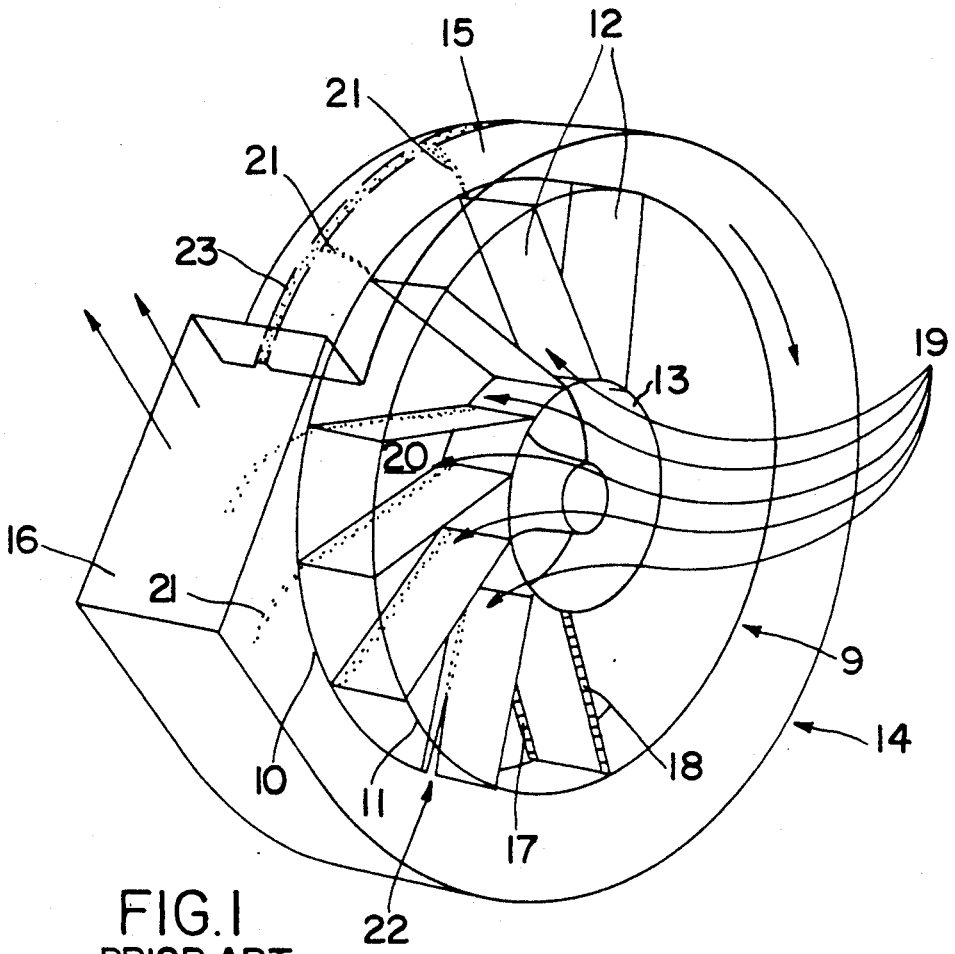
FIG.1 PRIOR ART
FIG. 1 is a schematic perspective part cut-away view of a prior art fan of a road sweeping vehicle.
Figure 2:
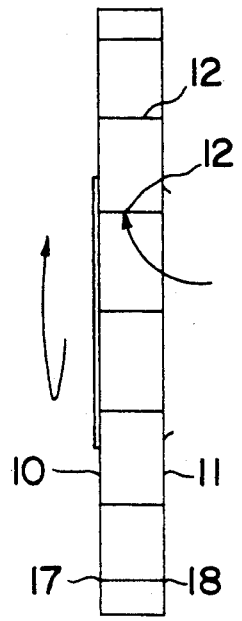
FIG.2 PRIOR ART
FIG. 2 is a schematic end elevation of the impeller of the fan of FIG. 1 with parts omitted for clarity.

The prior art impeller 9 shown in FIG. 1 comprises a circular back plate 10, a circular front plate 11 and a plurality of blades 12 therebetween. The blades 12 are each joined at one end to a generally cylindrical hub 13 so that when the impeller is viewed from the side as shown in FIG. 2, the opposite ends of the blades are horizontal. Means (not shown) are also provided for rotating the hub to thereby rotate the impeller 9. The impeller 9 is housed in casing 14 having a volute portion 15 and an air outlet 16. The sides of each blade 17 and 18 are welded to the back plate 10 and front plate 11 of the impeller 9. Front plate 11 has an air inlet 19, to allow air to enter the impeller 9.

In use, the impeller 9 rotates up to and above 3000 revolutions per minute and draws air in to the impeller through air inlet 19 in front plate 11. As the air enters the impeller 9 it strikes back plate 10 and is forced to turn abruptly into the blade passage 20. As it strikes the back plate 10 particles of dirt and dust 21 are separated from the air, because of their greater density and inertia than the air they are entrained in. These particle 21 collect on the blades 12 against back plate 10 and are rotated as the blades 12 are rotated. As the impeller 9 rotates the abrasive particles 21 flow along the blades 12, centrifugal force being responsible for the increasing velocity of the particles 21 as they move towards the end of the blades 12, until they are thrown off the end of the blade 12 against the inner surface of the casing volute 15.

The particles 21 leaving the impeller blades 12 tend to be in a narrow radial band and erodes the blades 12 until a slit 22 appears in the outer end of the blade 12 which eventually splits the entire blade 12 into two pieces. When a sufficient number of blades 12 are split, the remaining complete blades 12 are unable to hold the front and back 10 plates together and impeller 9 itself divides.

Furthermore, as the particles 21 leave the blades they impinge on the inner surface of the casing volute 15 still in a narrow radial band, which causes erosion of the casing 15 in a similar manner to that of the blades 12 and can result in the casing 15 itself splitting at a weakened point 23.

The impeller blades 12 are flat and straight with their faces arranged parallel to the axis of rotation of the impeller 9 and are generally inclined backwards relative to the radial direction of the impeller 9 at an angle of 15°. This design provides a self cleaning action to prevent material from building up on the working and back faces of the blades which could cause out of balance problems.

Figure 3:
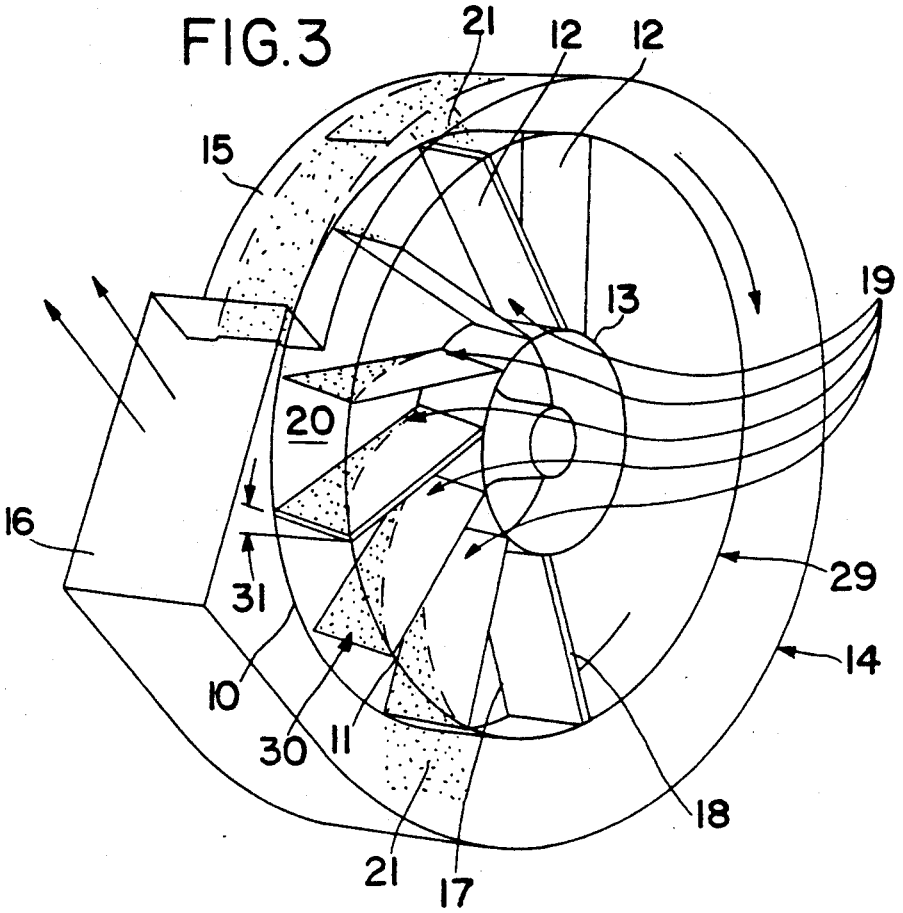
FIG. 3 is a schematic perspective of part cut-away view of an improved fan for a road sweeping vehicle.
Figure 4:
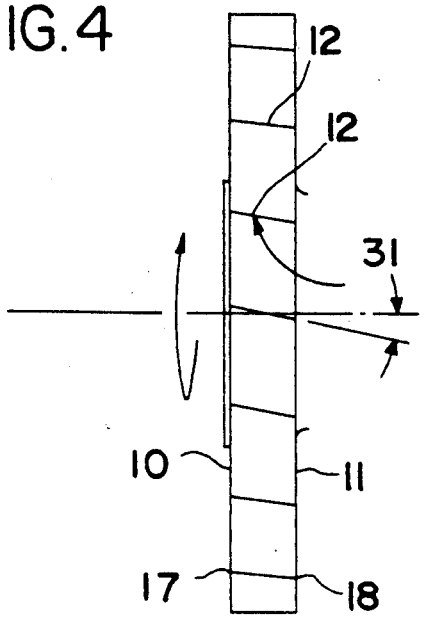
FIG. 4 is a schematic side elevation of the impeller of the fan of FIG. 3.

In the preferred embodiment of the invention shown in FIGS. 2 and 3 an impeller 29 comprises blades 12 which are welded to front and back plates 10 and 11 so that the blade 12 is tilted relative to the axial direction of the impeller 29. As shown in FIG. 4 blade edge 18 is vertically lower than edge 17. Thus blade edge 17 becomes a leading edge so as to impart a lateral sideways vector, as well as a radial one, to the airstream and abrasive particles 21 as the air passes along the blade passage 20. Thus as the particles 21 travel along blade 12 they are increasingly scattered so that the wear they cause is not concentrated in the narrow band as shown in FIG. 1, but now in a broader pattern 30 across the width of the blade 12, as shown in FIG. 2. The effect being that the density of the particle 21 is much lower than before and so the erosion process much slower. The broader end of the pattern 30 is at the blade's tip, which previously was the critical start point of wear, which caused the weakened area 22 to be formed in the prior art blade.

The preferred angle of tilt 31 of the blades 12 relative to the axial direction lies between 5° and 12°, the most beneficial results resulting from an angle of tilt 31 of 8°. The angle of tilt 31 will partly depend on the width of blade 12, the rotational speed and lateral vector desired.

Another major benefit is that: the particles 21 also leave the blades 12 in a much less dense and broader band so that the wear life of the casing 14 is much enhanced by spreading the wear across a wider band.

In a preferred embodiment of the invention the impeller 29 has fifteen blades 12, every third one of which is thicker than the other blades 12. This results in the impeller 29 having ten blades 12 of normal thickness, say, 3 mm and five blades of increased thickness, say, 5 mm. These measurements are not limiting and the thickness of the blades 12 will be selected according to the size of the impeller 29 and its function preferably but not solely in the range 1 mm to 8 mm for the normal blades and 2 mm to 12 mm for the thicker blades. This construction provides a further safety feature, whereby after a period of severe wear where the thinner blades have worn away, the five thicker blades will still have sufficient strength to withstand disintegration. Once the ten thinner blades have worn away, performance decays and the airstream suffers to the extent where dust particles 21 would not be entrained by the airstream and therefore will not cause further wear to the "safety" blades. Thus, the fan can continue to be used until it no longer acts efficiently, without the risk of the impeller 29 dividing. Obviously, other combinations of thick and thin blades 12 can be used, apportioned to give the required benefits and wear indication. Similarly, the angle of tilt 31 may be varied to spread the zone of wear across the blade 12.

Preferably, the blades 12 are made of an abrasion resistant material and in an impeller 29 used in a fan for a road sweeper, the impeller is preferably made of a metallic material which withstands atmospheric attack.

We claim:

1. A fan impeller comprising a back plate, a front plate and a plurality of blades lying between the front plate and the back plate, wherein the blades are tilted relative to the axis of rotating of the impeller at an angle of between 5° and 12° to provide a leading edge adjacent said back plate so as to impart, in use, a lateral sideways vector to a stream of air passing along the blades.

2. A fan impeller as claimed in claim 1 in which the angle of tilt is 8° relative to the axis of rotation of the impeller.

3. A fan impeller as claimed in claim 1 in which the blades are of metal.

4. A fan impeller as claimed in claim 1 in which the blades are made of an abrasion resistant material.

5. A fan impeller as claimed in claim 1 in which the blades are made of a corrosion resistant material.

6. A fan impeller as claimed in claim 1 in which at least two of the blades are of an increased thickness than the remaining blades.

7. A fan impeller as claimed in claim 6 in which the increased thickness blades have a nominal thickness of between 2 mm and 12 mm and the remaining blades a nominal thickness of between 1 mm and 8 mm.

8. A fan impeller as claimed in claim 7 in which the increased thickness blades have a nominal thickness of 5 mm and the remaining blades a nominal thickness of 3 mm.

9. A fan impeller as claimed in claim 6 in which 5 blades are of an increased thickness than the remaining blades.

10. A fan impeller as claimed in claim 6 wherein the blades are tilted in relation to the axis of rotation of the impeller to provide a leading edge adjacent said back plate so as to impart, in use, a lateral sideways vector to a stream of air passing along the blades.

11. A fan impeller as claimed in claim 6 in which the blades are of metal.

12. A fan impeller as claimed in claim 6 in which the blades are made of an abrasion resistant material.

13. A fan impeller as claimed in claim 6 in which the blades are made of a corrosion resistant material.

* * * * *